United States Patent [19]

Okano et al.

[11] Patent Number: 4,953,720

[45] Date of Patent: Sep. 4, 1990

[54] CRANE AND METHOD FOR USING CRANE

[75] Inventors: Tadashi Okano; Tadayoshi Honda, both of Tokyo, Japan

[73] Assignee: Shimizu Construction Co., Ltd., Tokyo, Japan

[21] Appl. No.: 422,950

[22] Filed: Oct. 17, 1989

[30] Foreign Application Priority Data

Oct. 21, 1988 [JP] Japan ..... 63-265855

[51] Int. Cl.[5] ..... B66C 23/34

[52] U.S. Cl. ..... 212/176; 212/182; 212/188; 212/261; 414/750; 414/10

[58] Field of Search ..... 212/175, 176, 179, 188, 212/182, 183, 261; 414/750, 10, 11, 12

[56] References Cited

U.S. PATENT DOCUMENTS 3,250,401 5/1966 Davidson ..... 212/176
3,366,251 1/1968 Strand ..... 212/176
3,557,967 1/1971 Madole ..... 212/188
4,738,583 4/1988 Macconochie et al. ..... 414/750

*Primary Examiner*—Sherman D. Basinger
*Assistant Examiner*—Thomas J. Brahan
*Attorney, Agent, or Firm*—Darby & Darby

[57] ABSTRACT

A crane comprises a base, a driving body for driving and controlling the crane disposed on the base rotatable in a horizontal plane, an articulated arm attached to the driving body pivotable in a vertical plane, and a clutching means for clutching the construction elements. The arm is folded and extended in a vertical plane. The clutching means is tiltably and detachably connected to a forward end of the arm. The crane further comprises a fixing means tiltably and detachably connected to the forward end of the arm as a substitute for the clutching means. The fixing means is capable of being fixed to the construction, so that the driving body can be moved while the fixing means is fixed to the construction.

7 Claims, 9 Drawing Sheets

CRANE AND METHOD FOR USING CRANE

BACKGROUND OF THE INVENTION

The present invention relates to a crane which is suitable for example, for constructing a steel framework structure and a method for using the crane. More specifically, the present invention relates to a crane which has an arm having a plurality of pivotably jointed portions.

Conventionally, cranes are utilized in order to construct steel framework structures for reinforced concrete construction. If the construction is multistoried or semi-multistoried, tower-cranes are used having a revolving turntable which can be lifted according to the height of the construction by a climbing mechanism.

However, during construction of a steel framework structure using a tower-crane, steel bars etc. lifted by the crane swing to-and-fro, which makes it difficult to place the bars at proper positions and which necessitates the operator must be highly skilled. Furthermore, it is necessary to carry the construction elements such as bolts and nuts to and from another lift apparatus. These result in additional costs and a longer construction time.

Therefore, there has been a recent demand for multi-operative cranes which can be utilized not only for lifting object such as steel bars but also for assisting in the construction operation by enabling control of the position and direction of the objects being lifted. FIG. 16 shows one of these multi-operative cranes comprising a mast 1 erected on the ground, a revolving turntable 2 installed on the upper end of the mast 1 rotatable about a vertical axis, an arm 3 disposed on the revolving turntable 2 for upward and downward movement, and a clutching mechanism 4 attached to an end of the arm 3 for clutching construction elements such as steel bars F.

The arm 3 comprises four arm members 3*a*, 3*b*, 3*c*, and 3*d*, that are connected to each other to pivot about horizontal axes. These arm members 3*a*, 3*b*, 3*c*, and 3*d* are pivoted by hydraulic cylinders 5.

With such a multi-operative crane, not only can the mere lifting of steel bars or the like, be accomplished but also objects can be raised with control of their position and direction.

However, the multi-operative crane has the following problems of which it is an object of the present invention to solve:

Usually, for constructing steel framework structures, it is necessary to lift or move the crane depending on the situation of the construction site and the crane has to carry the raising object to the construction site. However, the conventional crane cannot be moved easily and consequently the range of reach of its arm 3 is limited. Therefore, the conventional crane is not always useful depending on the construction situation. Also, considerable cost and time for construction is needed since the components in the construction must be conveyed by lifting stages with a small lift.

Furthermore, another crane must be utilized for moving and assembling the crane. Especially, if another tower-crane is utilized for this, a climbing mechanism only used for the tower crane is needed, so that additional cost is involved.

SUMMARY OF THE INVENTION

It is therefore an object of the present invention to provide a crane and a method for using the crane which enable positioning and relocation to be easily achieved.

It is another object of the present invention to provide a crane which is of utility in any step of the constructing operation of steel framework structure.

It is a further object of the present invention to provide a crane and a method for using the crane, which can improve the carrying and installation operation of the elements used in a construction site, so that the cost and the term for construction can be reduced.

According to an embodiment of the present invention, the crane comprises a base, a driving body for driving and controlling the crane disposed on the base rotatable in a horizontal plane, an articulated arm attached to the driving body pivotable in a vertical plane, and a clutching means for clutching the construction elements. The arm is folded and extended in a vertical plane. The clutching means is tiltably and detachably connected to a forward end of the arm. The crane further comprises a fixing means tiltably and detachably connected to the forward end of the arm as a substitute for the clutching means. The fixing means is capable of being fixed to the construction, so that the driving body can be moved while the fixing means is fixed to the construction.

In use the crane, the clutching means is detached from the forward end of the arm. The fixing means is attached to the forward end of the arm after detaching the clutching means. The attached fixing means is fixed to a prescribed position of a construction. The driving body is moved to a prescribed location while the fixing means is fixed to the construction. Then, the fixing means is released from the prescribed position of the construction.

More preferably, in the crane, the base includes an elongated post of adjustable height which stands upright on the base. The driving body is disposed on the post rotatably in a horizontal plane and movable upward and downward.

In order to use the crane, the clutching means is detached from the forward end of the arm. The fixing means is attached to the forward end of the arm after detaching the clutching means. The attached fixing means is fixed to a prescribed position selected from one of the construction and an upper end of the post. The driving body is moved to a prescribed elevation along the post which stands on the base while the fixing means is fixed to the construction. Then, the fixing means is released from the prescribed position.

DETAILED DESCRIPTION OF THE PREFERRED EMBODIMENTS

With reference to the accompanying drawings, preferred embodiments of the present invention will be described hereinafter.

Figure 1:
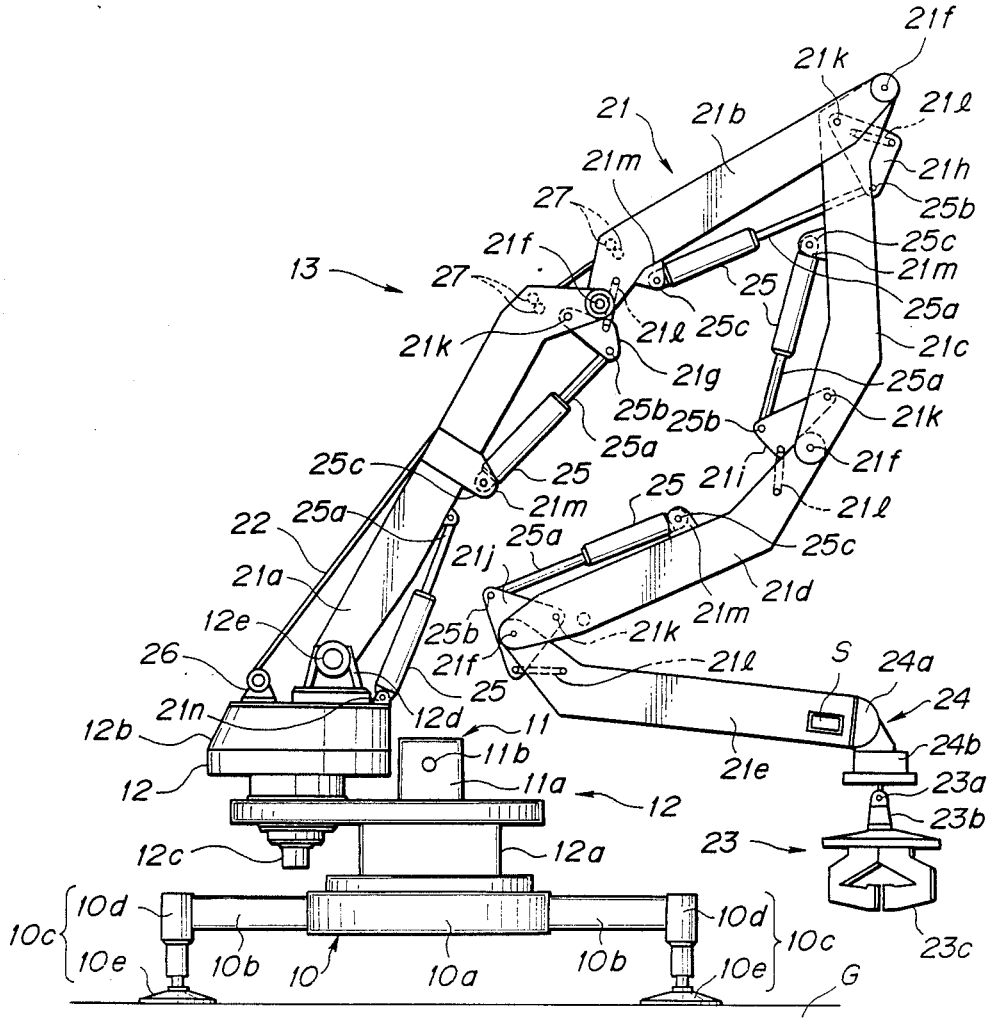
FIG. 1 is a side view showing a crane according to the present invention.

FIG. 1 is a side view depicting a crane which comprises a base 10, a post 11 standing on the base 10 and extendable in a vertical direction by means of adding accompanying post segments 11*a*, a driving body 12 disposed on the post 11 movable upward and downward, and a hanging means 13 having an articulated arm 21 installed on the driving body 12.

The base 10 comprises a stage 10*a* of a rectangular shape for supporting the post 11 and two pairs of outriggers 10*c*. Each of the outriggers 10*c* comprises a horizontal arm 10*b* extended horizontally from the stage 10*a*, a leg 10*e* contacting the ground G, and a hydraulic cylinder 10*d* interposed between the arm 10*b* and the leg 10*e* for extending the leg 10*e* in a vertical direction.

The post 11 on the base 10 is constituted by one or more post segments 11*a* of a cylindrical shape. The height can be adjusted by adding or subtracting the post segment or post segments 11*a*, or replacing a segment 11*a* by a longer or shorter segment. In the figure, a relatively short post segment 11*a* with an end secured to the stage 10*a* of the base 10, is shown. Connection of the segments 11*a* is achieved by a bolt-nut joint. On the peripheral surface of the segment 11*a*, is formed a hole 11*b* for insertion of a fixing pin of a driving body 12.

The driving body 12 comprises a table 12*a* having a hole through which the post 11 is inserted, and a revolving stage 12*b* which is rotatably installed on the table 12*a* and includes a power unit therebetween. The driving body 12 further comprises driving switches (not shown) for driving the controlling the crane.

For raising and lowring the driving body 12, the articulated arm 21, which will be described later on, is set on a part of the building-construction or a top end of the post 11 and is controlled so as to bent in such a manner that a reaction force is applied to the location at which the arm 21 is set, whereby the driving body 12 is raised or lowered along the post 11. Then, the fixing pin provided in the table 12*a* is inserted into the hole 11*b* by hydraulic pressure to fix the driving body 12 to the post 11. A motor 12*c* is disposed under the revolving stage 12*b*, whereby the angle of rotation in the horizontal plane of the revolving stage 12*b* can be adjusted.

Figure 3:
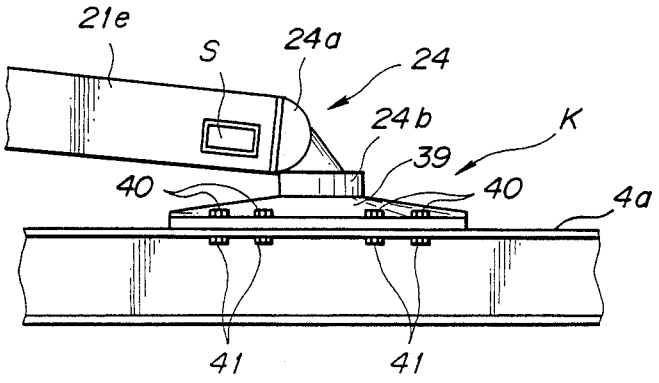
FIG. 3 is a side view of a fixing means used with the crane in FIG. 1.

The hanging means 13 comprises the articulated arm 21 which has a plurality of arm members connected end to end in series for pivotable movement about their respective joint portions, a supporting mechanism 24 installed at the forward end of the arms 21, and a clutching mechanism 23 detachably connected to a winding cable 22 wound around a winch 26 and passing through the articulated arm 21 and the supporting mechanism 24. As shown in FIG. 3, a fixing mechanism K can be installed on the hanging means 13 as a substitute for the clutching mechanism 23 in order to set the forward end of the arm on the building-construction.

Returning to FIG. 1, the arm 21 can be folded and extended by a plurality of driving means, each of which includes a hydraulic cylinder 25 disposed at the joint portion. The arm member 21*a*, which is the nearest of the arm members to the driving body 12, is connected pivotably via a hinge pin 12*e* to a bracket 12*d* disposed on the revolving stage 12*b*. The other arm members 21*b*, 21*c*, 21*d*, and 21*e* are jointed to one another via hinge pins 21*f* disposed at the joint portions among the arm members 21*a*, 21*b*, 21*c*, 21*d*, or 21*e*.

At the joint portions, hinge members 21*g*, 21*h*, 21*i*, and 21*j* of triangular shape, are also installed respectively. An apex of each of the hinge members 21*g*, 21*h*, 21*i*, and 21*j* is connected to a rearward corresponding arm member 21*a*, 21*b*, 21*c*, 21*d* by a hinge pin 21*k*. Another apex of each of the hinge members 21*g*, 21*h*, 21*i*, and 21*j* is connected to the forward corresponding arm member 21*b*, 21*c*, 21*d*, or 21*e*, via a connecting link 21*l*. The remaining apex of each of the hinge members 21*g*, 21*h*, 21*i*, and 21*j* is connected to the rod 25*a* of the corresponding cylinders 25 via a hinge pin 25*b*. The bodies of the cylinders 25 are connected respectively to brackets 21*m* which are disposed respectively on the arm members 21*a*, 21*b*, 21*c*, and 21*d* via hinge pins 25*c*.

The winding cable 22 is routed through all arm members 21*a*, 21*b*, 21*c*, 21*d*, 21*e*, and 21*e*, in such a manner that the cable 22 is supported between pairs of pulleys 27, each pair being disposed near the joint portion of the corresponding arm member, so that movement of the cable 22 is not obstructed by the arm 21 even if the arm 21 is folded. An end of the winding cable 22 is wound around a winch 26 mounted on the revolving stage 26. A control unit S for controlling the power unit of the revolving stage 12*b* is installed on the arm member 21*e* remotest from the driving body 12, so that the hanging means 13 can be controlled by an operator near the forward end of the arm 21.

Figure 2:
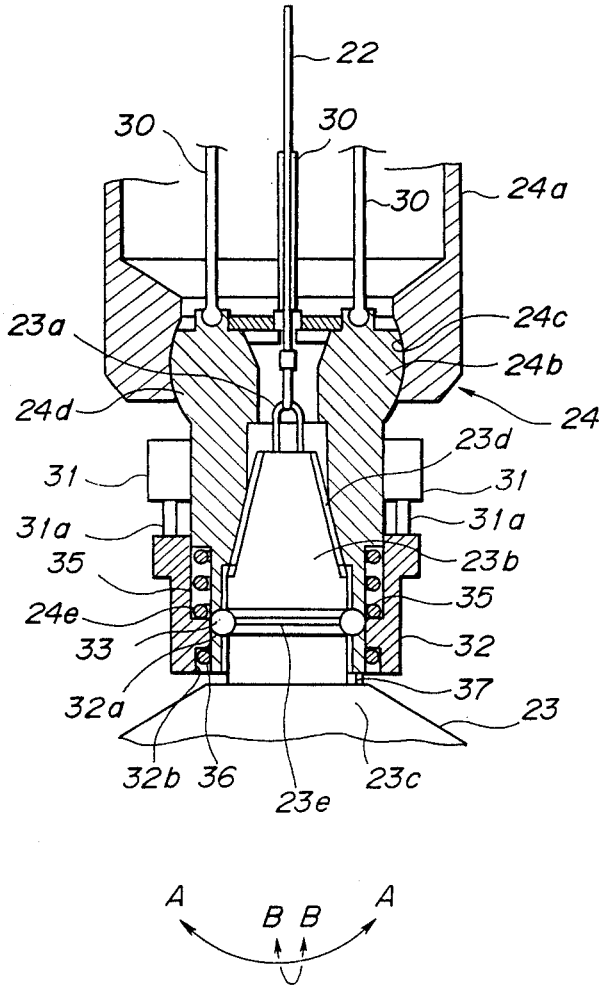
FIG. 2 is an enlarged cross-sectional view of a supporting mechanism used in the crane in FIG. 1.

As best shown in FIG. 2, the clutching mechanism 23 for clutching steel bars and the like comprises a hook portion 23*a* hanging from the winding cable 22, a connector portion 23*b* hanging as one with the hook portion 23*a* and held in spline-engagement with the supporting mechanism 24, and a clutching portion 23*c* detachably affixed to the connector portion 23*b*. The clutching portion 23*c* can be chosen and replaced to suit the object being hung. In FIG. 1, the clutching portion 23*c* consists of a pair of vise like jaws. The jaws can be opened and closed by an actuator driven by an electric-generator or batteries mounted in the clutching mechanism 23.

While spline-grooves 23*d* are formed on a conical upper portion of an outer peripheral surface of the connector portion 23*b* along the generating lines of the conical shape, annular grooves 23*e* are circumferentially formed on a cylindrical lower portion of the outer peripheral surface of the connector portion 23*b*, so that the clutching mechanism 23 can be engaged with the supporting mechanism 24 in a non-rotatable manner.

The supporting mechanism 24 for supporting the clutching mechanism 23 comprises a supporting cylinder 24*a* unitedly attached to the arm member 21*e*, and a substantially cylindrical grip frame 24*b* pivotably connected at its ball portion 24*d* to the supporting cylinder 24*a*.

On the inside of the supporting cylinder 24*a*, a spherical concave sliding surface 24*c* is formed as viewed in FIG. 2. The ball portion 24*d* of the grip frame 24*b* is rotatably engaged with the concave sliding surface 24*c*. The ball portion 24*d* of the grip frame 24*b* has two sets of rods 30 of which lower ends are held in ball-engagement with the upper portion of the ball portion 24*d*. The opposing rods 30 are disposed in parallel relation one another with the rods 30 angularly spaced at 90° around a center hollow of the grip frame 24b in such a manner that a set of rods 30 are opposed diametrically and another set of rods 30 are also opposed diametrically. The upper ends of the rods 30 are extendably disposed in the most forward arm member 21e. When a rod 30 is extended, the opposite rod 30 is retracted while the other set of the rods are not extended or retracted, thereby tilting the grip frame 24b in a direction shown by the arrow A—A or arrow B—B in FIG. 2.

On an outer peripheral surface of the grip frame 24b, a plurality of double acting cylinders 31 are disposed at suitable spacing around the periphery. Lower ends of rods 31a of the cylinder 31 are secured to a slide shell 32. The slide shell 32 is moved along the grip frame 24b for slidable insertion of a lower portion of an outer peripheral surface of the grip frame 24b. When the slide shell 32 is at a lowermost position, an annular inner ridge 32a projecting radially inwards urges supporting balls 33 radially inwards, each of which has a part projecting from a hole 24e of the grip frame 24b, so as to restrict the radially outward movement of the balls 33. The balls 33 are greater in diameter than that of the hole 24e, so that the balls 33 cannot pass throughout the hole 24e. When the slide shell 32 is at an uppermost position, a lower inner wide-diameter portion 32b is at the same elevation to the supporting balls 33, so as to allow the radial outward movement of the balls 33 in a prescribed range. The slide shell 32 is always urged downwards relative to the grip frame 24b by a spring 35 towards the lowermost position defined by stopper 36. A limit switch 37 detects the lowermost position of the side shell 32.

FIG. 3 shows a fixing device K for the hanging means 13. The fixing device K involves a fixing plate 39 which has bolt holes to enable bolting of the fixing plate 39 to a flange of a steel bar 4a by bolts 40 and nuts 41. The fixing plate 39 includes a hook portion similar to that shown in FIG. 2, hung from the winding cable 22 for connecting to the supporting mechanism 24. The fixing plate 39 further includes a connector portion 23b also similar to that shown in FIG. 2 for spline engagement with the supporting mechanism 24.

The structure of the fixing device K is not limited to that shown in FIG. 3, provided that a forward end of the arm 21 can be set securely.

Next, the operation of the crane will be described. The construction of a steel framework structure involves a frame-construction step including lifting of a steel bar by the hanging means 13 attached to the driving body 12, and assembling the steel bars to produced the steel framework structure; and a crane-moving step including attaching a forward end of the arm 21 to an upper floor of the steel framework structure by the fixing device K, and lifting the driving body 12 with the base 10 by folding the arm 21 in order to set the base 10 on the upper floor of the steel frame.

Figure 4:
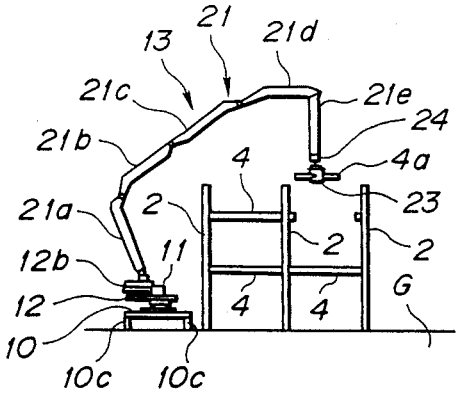
FIGS. 4 through 9 are side views of the crane of FIG. 1 showing steps of a method according to the present invention.

FIG. 4 shows the frame-constructing step. In the figure, the second floor of the steel frame has been built already. That is, girders 4 of steel bars have been bridged between columns 2 which have been erected on the ground G. The base 10 of the crane is kept horizontally by means of the outriggers 10c. The direction and the position of a steel bar, to be fixed to the steel frame, is controlled by means of control of the rotation and folding of the arm 21, and the tilting of the clutching means 23 about the supporting means 24.

In order to assemble the crane, the base 10 is mounted on the ground G and made horizontal with the outriggers 10c, and the driving body 12 is secured to the post 11 of the base 10. In order to lift the steel bars 4a which may be carried to the construction site by a truck, the arm 21 is controlled in horizontal and vertical directions and winch 26 winds the cable 22, so that the clutching mechanism 23 is disposed above the steel bars in a position to clutch one of the bars 4a. Next, the cable 22 is wound up by the winch 26, so as to raise the clutching mechanism 23 together with the steel bar 4a gripped by the clutching mechanism 23 into the supporting mechanism 24 whereby the clutching mechanism 23 is supported to prevent rotation of the clutching mechanism 23. As the winch 26 winds up the cable 22, the clutching mechanism 23 is raised and the connector portion 23b comes into engagement with the grip frame 24b. With the double acting cylinders 31 contracted and the slide shell 32 is located at the upper limit so as to allow a certain amount of movement of the supporting balls 33 in radial direction of the slide shell 32 so that when the connector portion 23b is raised, the supporting balls 33 move outward in the radial direction.

When the connector portion 23b reaches the upper limit, the limit switch 37 operates to interrupt the winding of the cable 22 by the winch 26 and the double acting cylinders 31 are extended to lower the slide shell 32. Then, the annular inward ridge 32a urges the supporting balls 33 so as to restrict the radially outward movement of the supporting balls 33 which engage with the annular grooves 23e of the connector portion 23b via the hole 24e of the grip frame 24b, so that the connector 23b is prevented from detaching. In this way, the clutching mechanism 23 is supported by the supporting mechanism 24.

In this embodiment, since the position and the direction of the steel bars can be controlled by means of the control of rotation and folding of the arm 21, and rotation of the clutching means 23 about the supporting means 24, the accuracy for the positioning of the steel bars can be improved.

By repetition of the clutching-process whereby the steel bars are clutched by the clutching mechanism 23, the hanging process in which the steel bars are raised by winding the cable 22, and the controlling process for controlling the position and the direction of the steel bars by control of the rotation of the arm 21 and the clutching mechanism 23 and supporting mechanism 24 the third floor of the steel framework structure can be constructed.

Figure 5:
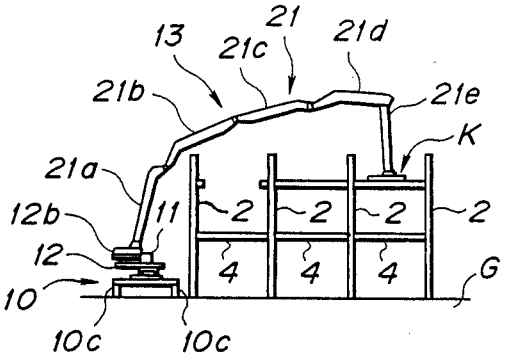
Figure 6:
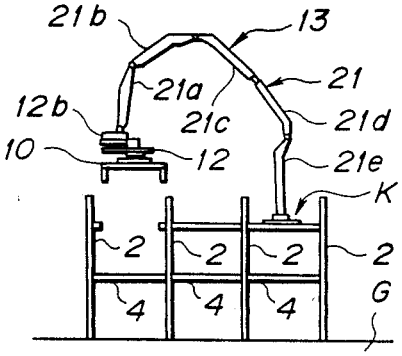

After that, the crane is moved up to the third floor. FIGS. 5 and 6 show the steps in moving of the crane. In FIG. 5, the forward end of the arm 21 is set securely on one of the steel bars which is fixed to the steel framework structure using the fixing device K. Then, in FIG. 6, the base 10 of the crane is raised by folding and rotation of the arm 21.

For the movement operation, the fixing device K of FIG. 3 is used to secure the forward end of the arm 21 instead of the clutching mechanism 23. The fixing plate 39 of the fixing device K is fixed to the girder 4 by bolts and nuts. After fixing of the fixing plate 39 to the girder 4, the base 10 is raised to position it on the third floor of the steel framework structure by controlling the folding of the arm 21 by the control unit S installed on the forward end of the arm 21. Then, the fixing plate 39 is released from the girder 4 and the fixing device K is replaced by the clutching mechanism 23.

Figure 7:
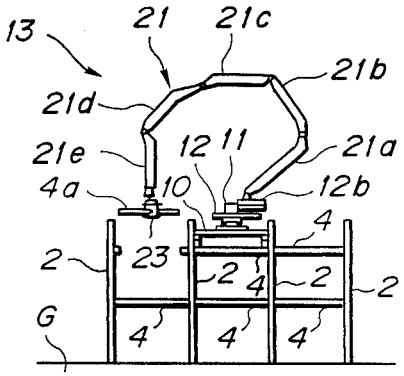
Figure 8:
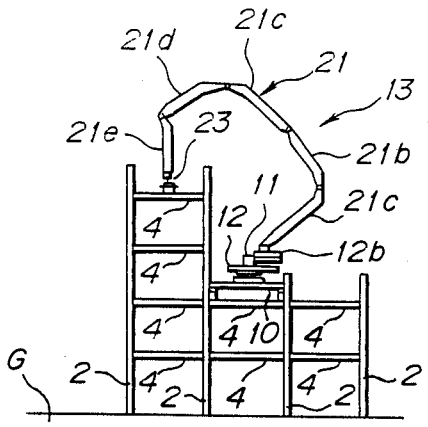
Figure 9:
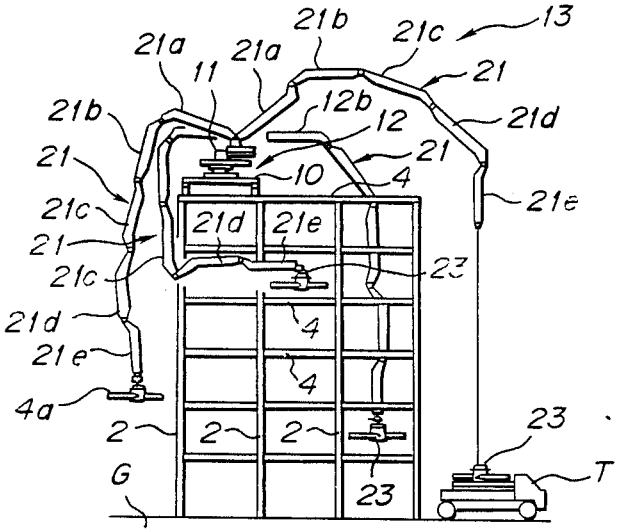

Next, as shown in FIG. 7, the crane, which is positioned on the third floor, is used to finish building the second floor of the steel framework structure. The crane builds upper floors of the steel framework structure as shown in FIG. 8 and then the process of raising the crane and constructing the steel framework structure is repeated so that the construction processes are continued.

Moving and positioning the construction elements except for the fixing step is achieved by the turning and folding of the arm 21 and the winding and unwinding of the cable 22. Therefore, the construction elements can be conveyed to the floors lower than the floor on which the crane is mounted. Furthermore, the elements can be conveyed horizontally by extending the arm 21. Consequently another lift is not necessary for moving the construction elements.

Figure 10:
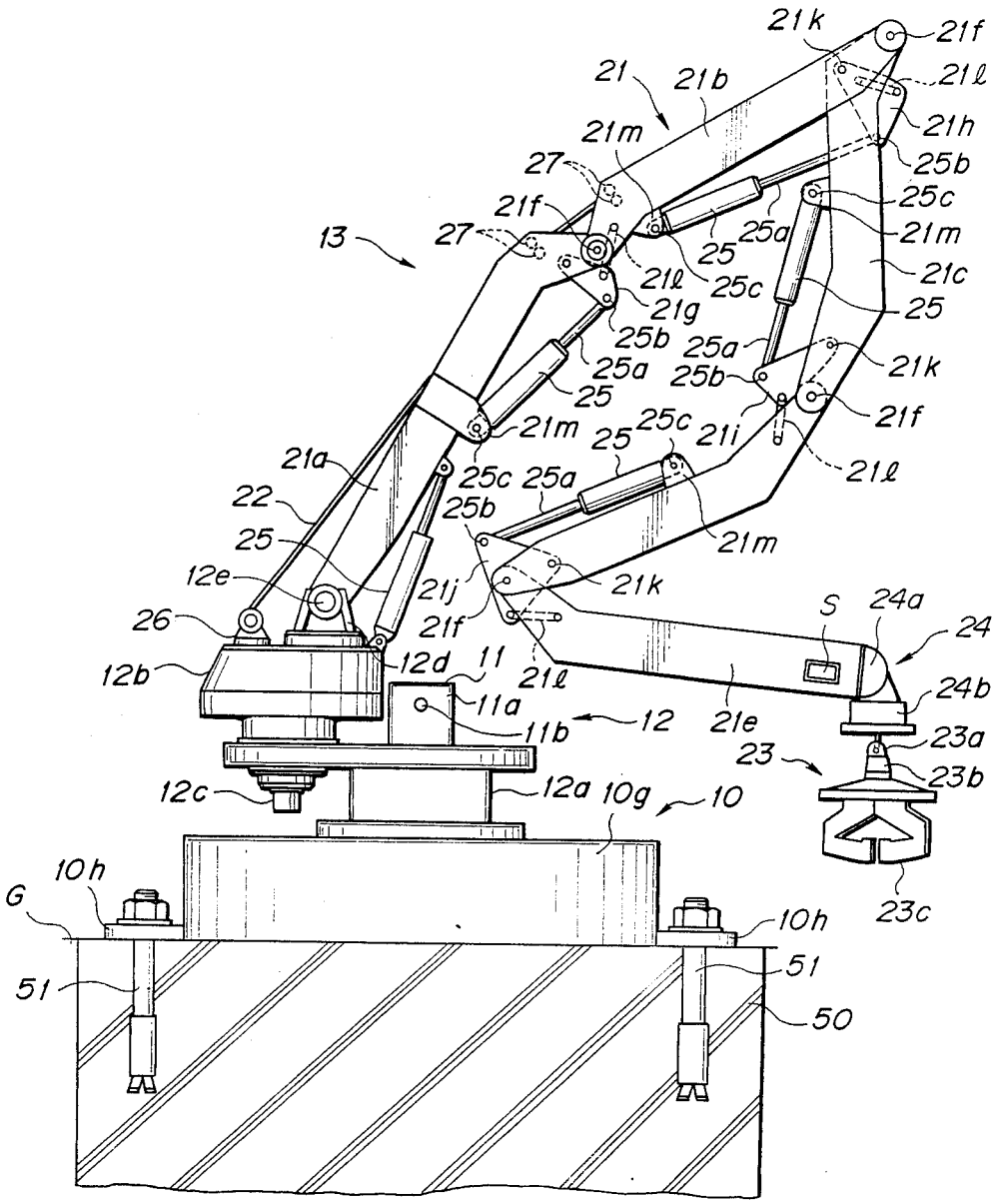
FIG. 10 is a side view of a modification of the crane in FIG. 1.

FIG. 10 depicts a modification of the crane. In this modification, the base 10 comprises a stage **10*g* including the post 11, and flange portions 10*h* protruding from the stage 10*g*. The base 10 of the crane is fixed by clamping the flange portions 10*h* with nuts threaded onto anchor bolts 51 embedded into a foundation 50**.

In order to lift the driving body 12, the height of the post 11 is adjusted by adding or subtracting the post segment **11*a*, or replacing the segment 11*a*** with another longer or shorter one.

Figure 11:
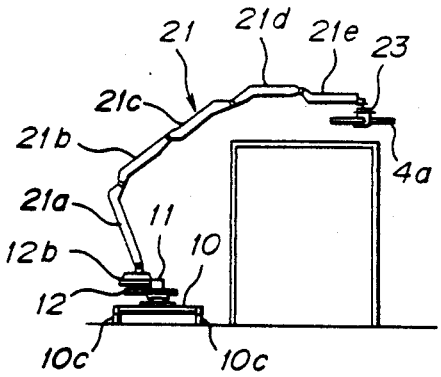
FIGS. 11 through 14 are side views of the crane of FIG. 10 showing steps of another method according to the present invention.
Figure 12:
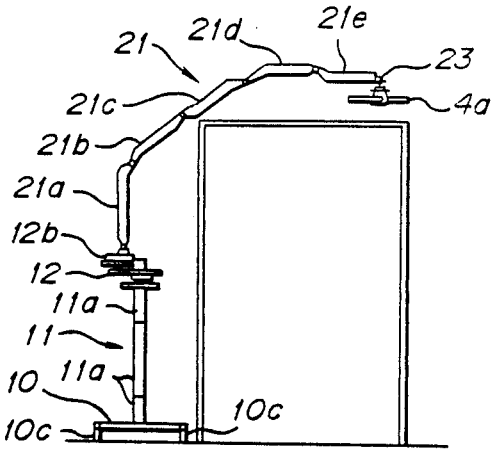

The procedure for lifting of the driving body is as follows: First, as shown in FIG. 11, the crane makes the steel framework structure with the steel bars **4*a*. Then, the post segments 11*a* are added to the post 11 by the arm 21. The fixing device K is secured to the forward end of the arm 21 as a substitute for the clutching mechanism 23 and is set securely on the top end of the post 11 or the steel framework structure. Then the arm 21 is folded so that a reaction force from the arm 21 is applied to the settled position, lifting the driving body 12 up the post 11. After raising the driving body 12 to a prescribed elevation, the driving body 12 is secured at that elevation and the fixing device K is released from the top end of the post 11 or the steel framework structure and replaced by the clutching mechanism 23**. In this way, the crane can be raised to enable construction of higher floors of the steel framework structure.

Figure 13:
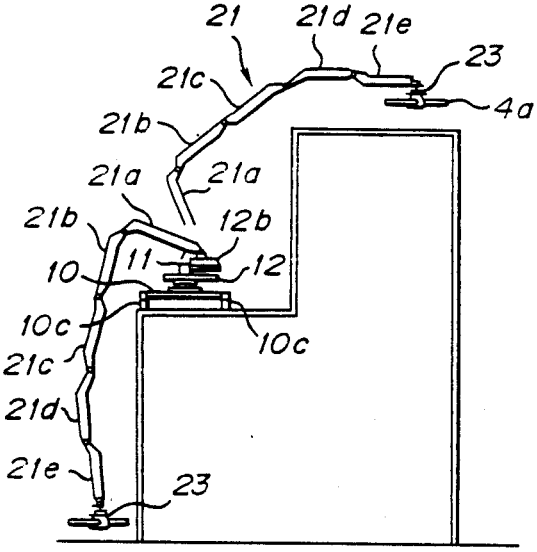
Figure 14:
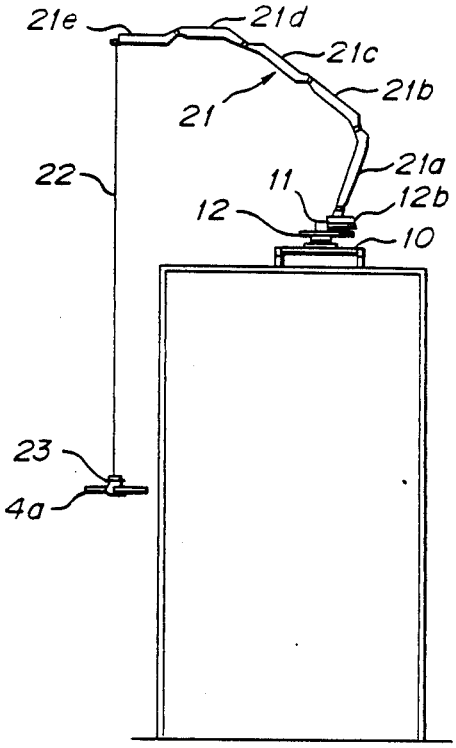

The above process for lifting the driving body 12 can be combined with the movement of the base 10 shown in FIGS. 13 and 14.

Figure 15:
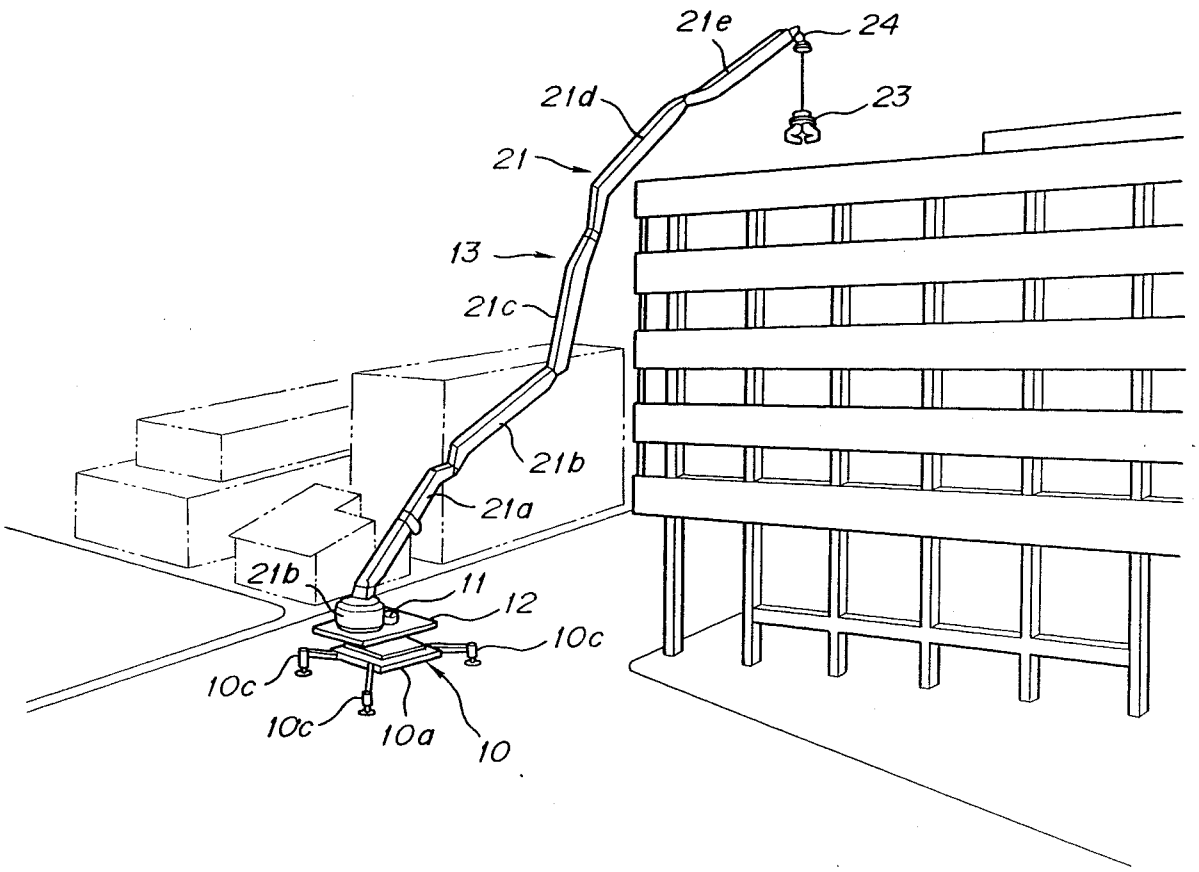
FIG. 15 is a perspective view of crane of FIG. 1 showing a use of the crane.
Figure 16:
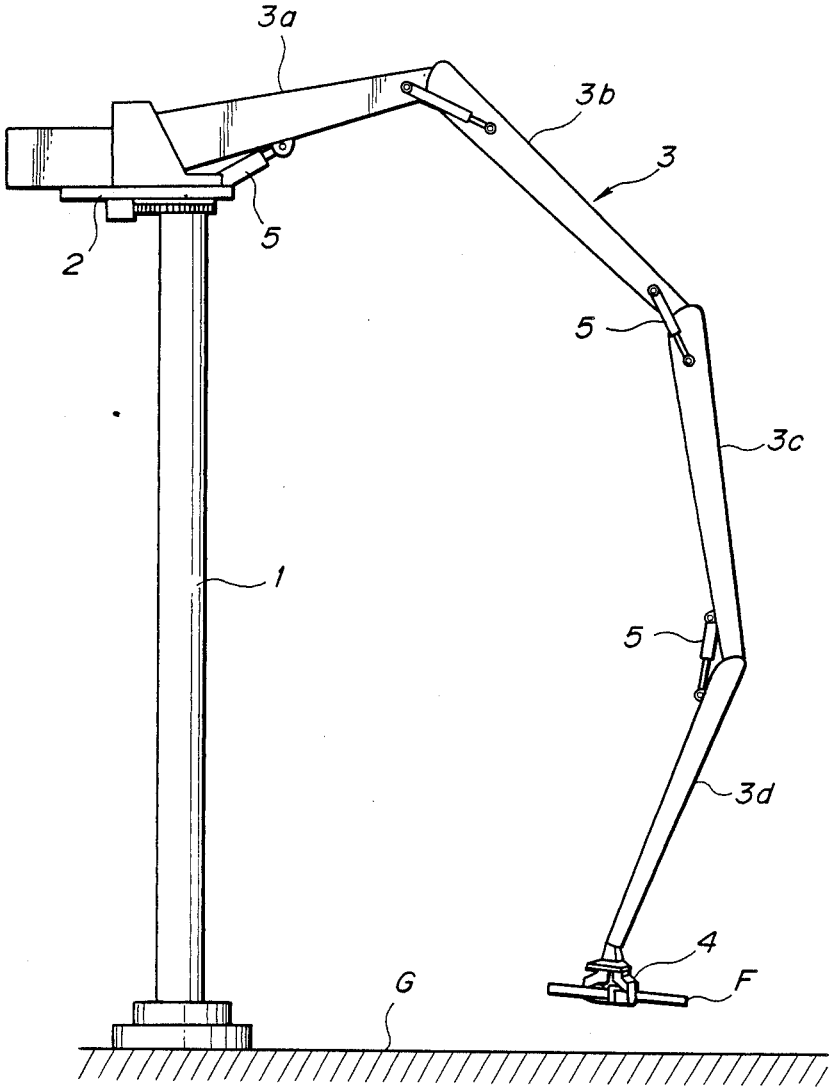
FIG. 16 is a side view of a crane of a prior art.

FIG. 15 shows another use of the crane. In the figure, the crane is installed on the ground G after completion of the steel framework structure. The crane is used for raising and lowering construction elements using the clutching mechanism 23.

As described above, the present invention has the following advantages.

(a) The crane can be moved vertically and horizontally easily at the construction site, by substituting the fixing device for the clutching mechanism. The crane is more convenient than conventional cranes since the operator can move the crane to a desirable location depending on the construction situation. Furthermore, construction elements can be moved over a large distance by the clutching mechanism making it unnecessary to install other equipment to move the construction elements to and from the crane. Hence cost for a construction operation can be reduced.

(b) The driving body can be raised and lowered since the height of the post is adjustable. Hence, the crane is more adaptable for construction situations since the operator can move the crane at a desirable location depending on the construction situation. Furthermore, the crane does not need a climbing means specially used for raising or lowering the crane so that the cost for whole apparatus can be reduced.

(c) The efficiency of the operation can be improved. Therefore, the cost and duration of the construction operation can be reduced.

What is claimed is:

1. A crane for conveying construction elements comprising:

(a) a base;

(b) a driving body for driving and controlling the crane disposed on the base rotatable in a horizontal plane;

(c) an articulated arm attached to the driving body pivotable in a vertical plane, the arm being folded and extended in a vertical plane;

(d) a clutching means for clutching the construction elements, the clutching means being tiltably and detachably connected to a forward end of the arm; and (e) a fixing means tiltably and detachably connected to the forward end of the arm as a substitute for the clutching means, the fixing means being capable of being fixed to the construction, whereby the driving body can be moved while the fixing means is fixed to the construction.

2. A crane according to claim 1, the crane further comprises a supporting means tiltably secured to the forward end of the articulated arm, the clutching means being supported by the supporting means via a winding cable extending at least from the supporting means to the clutching means, the fixing means being detachably and positively attached to the supporting means.

3. A crane according to claim 2, the crane further comprises a control unit disposed near the forward end of the articulated arm for controlling the crane.

4. A crane according to claim 3, wherein the base includes an elongated post of adjustable height which stands upright on the base, the driving body being disposed on the post rotatably in a horizontal plane and movable upward and downward.

5. A method for using a crane according to claim 4, the method comprises the steps of:

(a) detaching the clutching means from the forward end of the arm;

(b) attaching the fixing means to the forward end of the arm after detaching the clutching means;

(c) fixing the attached fixing means to a prescribed position selected from one of the construction and an upper end of the post;

(d) moving the driving body to a prescribed elevation along the post which stands on the base while the fixing means is fixed to the prescribed position; and (e) releasing the fixing means from the prescribed position.

6. A method for using a crane according to claim 1, the method comprises the steps of:

(a) detaching the clutching means from the forward end of the arm;

(b) attaching the fixing means to the forward end of the arm after detaching the clutching means;

(c) fixing the attached fixing means to a prescribed position of a construction;

(d) moving the driving body to a prescribed location while the fixing means is fixed to the construction; and (e) releasing the fixing means from the prescribed position of the construction.

7. A method according to claim 6, wherein the moving step comprises moving the base together with the driving body.

* * * * *